US009233816B1

(12) United States Patent
Mendez

(10) Patent No.: US 9,233,816 B1
(45) Date of Patent: Jan. 12, 2016

(54) BLIND FLANGE LIFTING DEVICE

(71) Applicant: The United States of America as represented by the Secretary of the Air Force, Washington, DC (US)

(72) Inventor: Edgar G Mendez, California City, CA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 14/479,468

(22) Filed: Sep. 8, 2014

(51) Int. Cl.
*B66F 19/00* (2006.01)
*B66C 1/66* (2006.01)

(52) U.S. Cl.
CPC ..... *B66C 1/66* (2013.01)

(58) Field of Classification Search
CPC ..... B66C 1/32; B66C 1/22; B66C 1/34; B66C 1/14; B66C 1/64; B66C 1/422; B66C 1/66; B25J 15/009; C03B 35/20; H01L 21/68707
See application file for complete search history.

(56) References Cited

U.S. PATENT DOCUMENTS

| | | | | |
|---|---|---|---|---|
| 447,386 | A * | 3/1891 | Vuillier | 74/571.11 |
| 1,795,406 | A * | 3/1931 | Frazer | 116/303 |
| 3,164,406 | A * | 1/1965 | Barry | 294/199 |
| 4,871,292 | A * | 10/1989 | Milanowski | 414/723 |
| 5,893,595 | A * | 4/1999 | Corbett | 294/102.1 |
| 7,556,160 | B2 * | 7/2009 | Porebski et al. | 212/179 |
| 8,434,800 | B1 | 5/2013 | LeBlanc | |
| 8,434,801 | B2 | 5/2013 | LeBlanc | |

* cited by examiner

*Primary Examiner* — Stephen Vu
(74) *Attorney, Agent, or Firm* — AFMCLO/JAZ; Jason Sopko

(57) ABSTRACT

A rigging device includes an eccentric sleeve having a generally cylindrical shape and an eccentric bore disposed at an offset distance from a centerline of the eccentric sleeve. A pin has a shaft and a head disposed at a first end of the shaft and a retaining feature disposed at a second end of the shaft. The shaft is disposed within the eccentric bore. A lifting lug is realeasably mated to the shaft and disposed between the eccentric sleeve and the retaining feature.

5 Claims, 3 Drawing Sheets

BLIND FLANGE LIFTING DEVICE

RIGHTS OF THE GOVERNMENT

The invention described herein may be manufactured and used by or for the Government of the United States for all governmental purposes without the payment of any royalty.

FIELD OF THE INVENTION

The present invention relates generally to rigging and hoisting equipment and, more particularly, to devices for lifting and manipulating structures having bores or bolt-holes.

BACKGROUND OF THE INVENTION

While various configurations of piping systems exist, one embodiment mates system components by use of a flange at each end of a pipe, valve, bulkhead, or the like. A gasket material is disposed therebetween, and a plurality of bores are disposed around the perimeter of the mating flanges. In one configuration, a first flange has threaded bores configured to receive bolts, machine screws, or the like, and a second flange is a through-bore configured with a clearance fit between the aforementioned threaded fastener. When the head of the fastener is tightened against the face of the through-bore flange, the second flange is pulled into contact with the first flange. In another configuration, bores on both flanges are through-holes, and a bolt and nut combination clamps the two flanges into contact with the gasket. The relation between the two flange planes is optimally parallel, and the thickness of the gasket material prevents the flange faces from touching. The resulting gap of the completed joint may approach 0.25 inches.

The flanged pipe, caps, valves, or other flanged accessory will be fabricated by selecting materials and dimensions that will support the pressure and structural considerations of the system. This will often result in heavy and unwieldy components that require (or at least benefit from), mechanical lifting aids. Slings, chains, and cables may be employed with overhead lifting aids and other rigging apparatus.

The state of the art requires that a lifting eye be welded to the face or edge of the flange. This eye results in a an undesirable protuberance, necessitates the use of a certified welder with accompanying weld quality testing, and significant time and money may be expended to prepare for the assembly of each flanged component.

Therefore there exists a need for attaching lifting apparatus to blind flanges, without welding and without interfering with the flange bolting process.

SUMMARY OF THE INVENTION

The present invention overcomes the foregoing problems and other shortcomings, drawbacks, and challenges of using welded lifting eyes. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a rigging device attachment is provided. The device includes an eccentric sleeve having a generally cylindrical shape and an eccentric bore disposed at an offset distance from a centerline of the eccentric sleeve. A pin has a shaft and a head disposed at a first end of the shaft and a retaining feature disposed at a second end of the shaft. The shaft is disposed within the eccentric bore. A lifting lug is realeasably mated to the shaft and disposed between the eccentric sleeve and the retaining feature.

According to another embodiment of the disclosed invention, a method of attaching a rigging device to a blind flange is provided. The method includes passing a head of a pin through a bore of the flange and translating the head of the pin an offset distance from a centerline of the bore of the flange. The method also includes placing an eccentric sleeve over a shaft mated to the head. The eccentric sleeve is dimensioned to maintain the head in a non-coaxial relationship with respect to the bore of the flange. The method also includes securing a lifting lug to the shaft with a retaining feature.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF THE INVENTION

Figure 1:
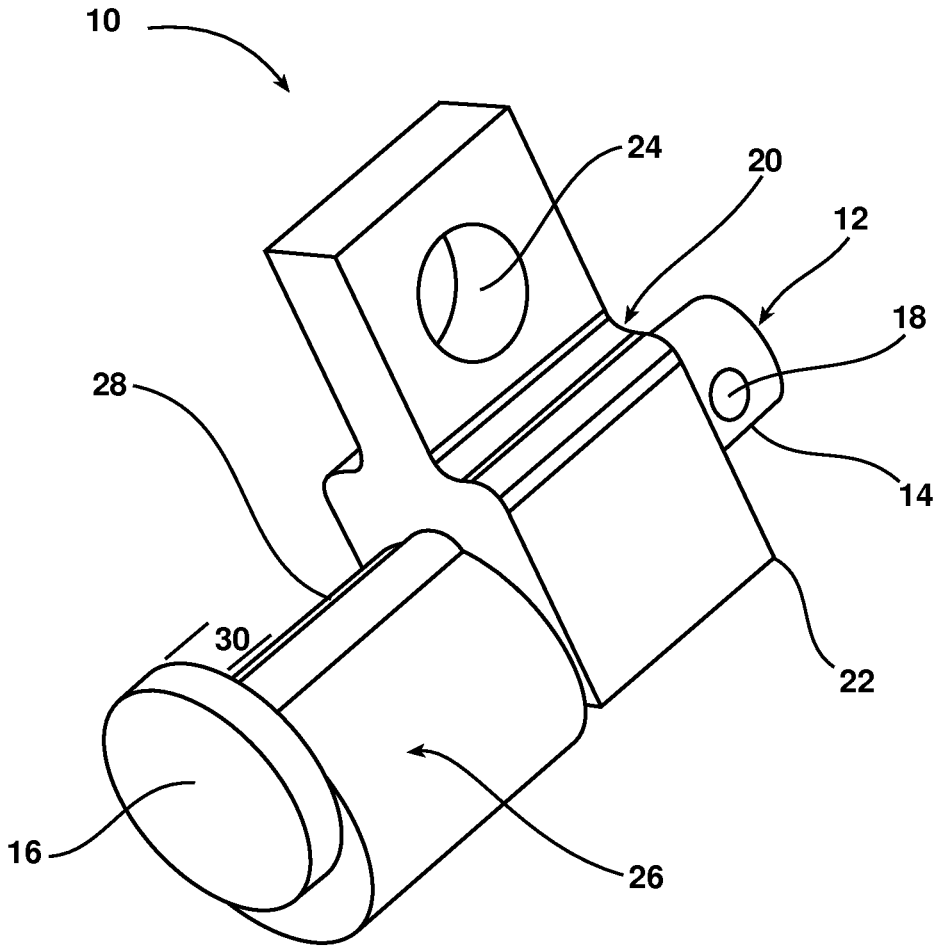
FIG. 1 is a perspective view of an embodiment of the disclosed invention.

FIG. 1 illustrates various components of an embodiment of a blind flange lifting device 10. The device 10 includes a pin 12 having a shaft 14 with a head 16 disposed at one end and a retaining feature 18 disposed near the other end of the shaft 14. In some embodiments the retaining feature may be a bore disposed in the pin 12 configured to receive a cotter pin, cross bolt, or other fastener known to the art. The diameter of the head 16 is dimensioned to provide a close, yet clearance fit, between itself and bores or bolt holes of the object that is to be lifted. The shaft 14 is dimensioned to provide sufficient strength for the weight of the object to be lifted, but as will be described below, the shaft 14 must be sufficiently smaller than the head 16 to facilitate a secure mating engagement with the flange or object to be lifted.

The shaft 14 of the pin 12 may be mated with a lifting lug 20. The lifting lug 20 may include a body 22 and an attachment point 24. In one embodiment of the disclosed invention, the attachment point may comprise a projection from the lifting lug 20 and the projection may include a bore or threaded bore. The attachment point 24 serves as an interface between the system 10 and external hoisting apparatus, to include, chain, clevis, carabineer, wire rope, synthetic rope, and the like. In some embodiments, the lifting lug 20 and the retaining feature 18 may be integrated. For example, if the retaining feature is transverse bore with carabineer passed therethrough, the carabineer and bore combination may be a sufficient rigging attachment point 24, serving as a lifting lug 20.

As will be described in greater detail below, the cooperation of the pin 12 and an eccentric sleeve 26. The eccentric sleeve 26 has an eccentric bore 28 disposed therein. The eccentric bore is dimensioned to provide a clearance fit with respect to the shaft 14 of the pin 12. Additionally, the eccentric bore 28 is positioned at an offset distance 30 from the centerline of the eccentric sleeve. When the device 10 is assembled, the offset distance 30 causes the head 16 of the pin 12 to extend beyond the perimeter of the eccentric sleeve 26.

Figure 2:
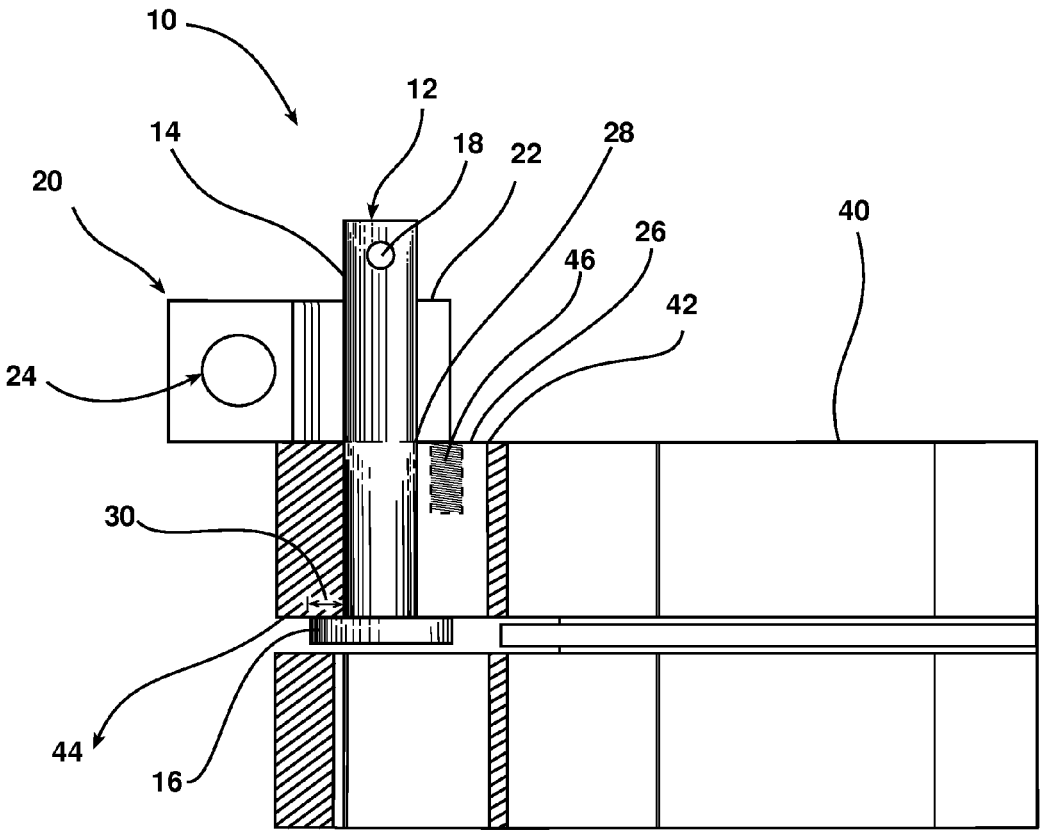
FIG. 2. is a cross sectional side view of an embodiment of the disclosed invention.

As seen in FIG. 2, in use, the device 10 is mated to a flange 40 by trapping the device within the bolt hole 42 of the flange 40. The pin 12 is lowered into the bolt hole 42 until the head 16 clears the back face 44 of the flange 40. The pin 12 is then displaced radially outwardly with respect to the flange 40, so that the head 16 of the pin 12 is trapped behind the flange 40 by the offset distance 30. In this configuration the shaft 14 and head 16 are no longer coaxial with the bolt hole 42, and attempting to withdraw the pin 12 causes the head to strike the back face 44 of the flange 40. However, by manipulating the pin 12 within the bolt hole 42 in such as was as to coaxially re-align the pin 12 with the bolt hole 42, removal is possible. Since this realignment may inadvertently occur during a dynamic lifting operation, the eccentric sleeve 26 is employed to retain the device 10 regardless of orientation of direction of loading. The eccentric sleeve 26 is slid over the shaft 14 thus filling the void between the shaft 14 and the bolt hole 42. The lifting lug 20 is then coupled to the shaft 14 and secured with the retaining feature 18. When the device 10 is correctly assembled, it cannot shift out of a locking engagement with the flange, regardless of orientation in space, angular displacement with respect to the flange 40, or other movement with the designed working load. A removal feature 46, which may include a threaded bore, t-slot, undercut face, or the like, may be used to facilitate removal of the eccentric sleeve 26 during disassembly and removal of the device 10.

Figure 3:
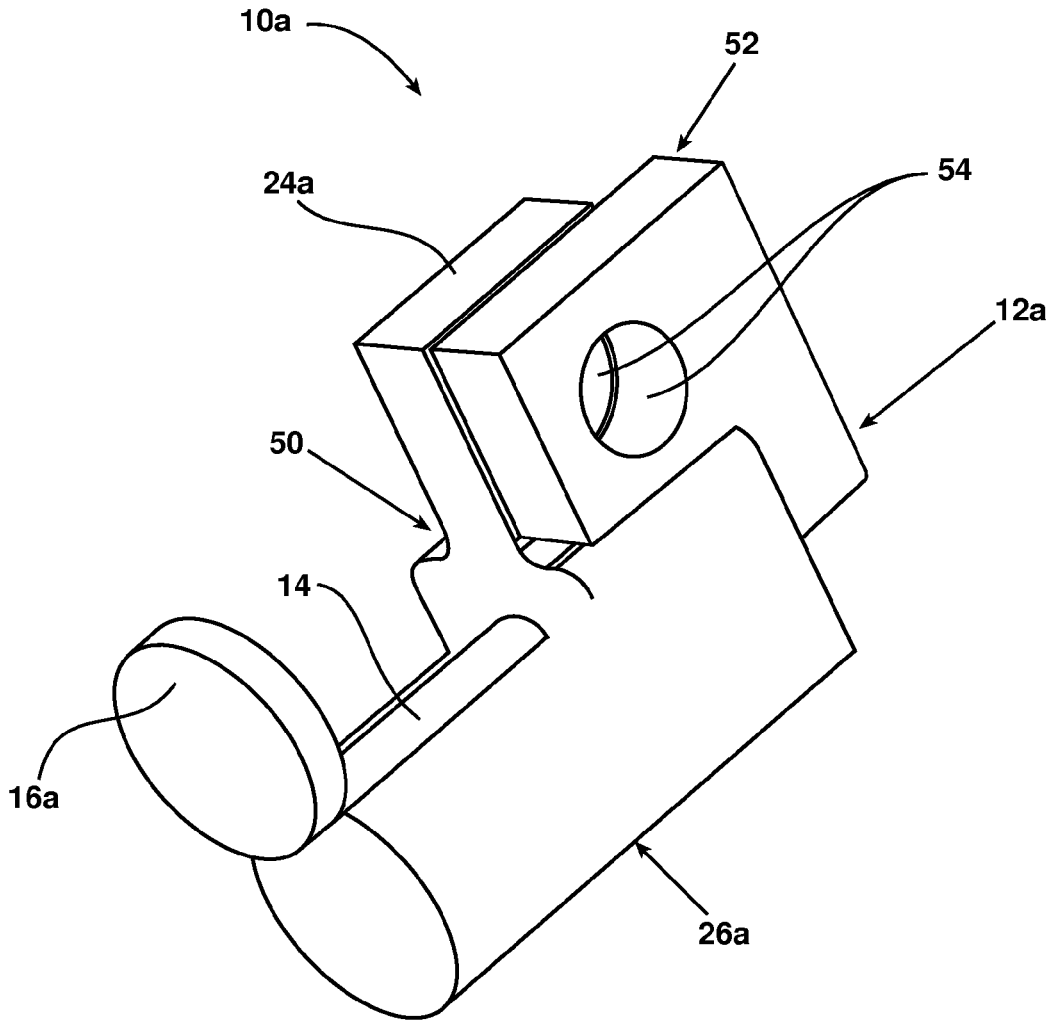
FIG. 3 is a perspective view of another embodiment of the disclosed invention It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

Turning attention to FIG. 3, another embodiment of the device 10*a* is shown. A locking body 50 includes an eccentric sleeve portion 26*a* and an attachment point portion 24*a* permanently joined (or fabricated from a monolithic structure). The captive pin 12*a* includes a locking arm 52 mounted on one end, and an eccentric head 16*a* disposed at the other end of the shaft 14. In the depicted position, the device 10*a* eccentric head 16*a* protrudes past the eccentric sleeve portion 26*a* (i.e., they are not coaxial), and the locking arm 52 is adjacent the attachment point portion 24*a*. To decouple the device 10*a* from a flange, the locking arm 52 and shaft 14 are pivoted 180 degrees, thus aligning the eccentric head 16*a* and the eccentric sleeve 26*a*. In some embodiments, the locking arm 52 (or the eccentric head 16*a* and cooperating shaft 14 in the absence of a locking arm 52) is retained by passing a shackle, clevis, locking pin, or the like through eyes 54. In other embodiments, the locking arm 52 is kept in place by detents, locking projections, serrated mating faces, set screws, cross bolts, safety wire, or other means to prevent inadvertent rotation known to those of ordinary skill in the art.

It should be recognized that the external shape of the eccentric sleeve 26 may be adapted to mate with various profiles found on a flange or other item to be hoisted. For example, the external shape of the eccentric sleeve 26 may be oval to accommodate elongated bores in flanges (wherein the elongated bores provide for a degree of adjustment or to accommodate variations in the hole pattern of mating flanges). Likewise, the shaft 14 and eccentric bore 28 may be fashioned from with a non-cylindrical profile, to limit rotation of one component with respect to the other. For example, square or hexagonal stock may be employed. Further, it is contemplated that two or more devices 10 or 10*a* may be used in a given lifting operation.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A rigging attachment device comprising:

an eccentric sleeve having a generally cylindrical shape and an eccentric bore disposed at an offset distance from a centerline of the eccentric sleeve, wherein the eccentric sleeve is configured to trap a rigging attachment within a hole of an item to be hoisted;

a pin having a shaft and a head disposed at a first end of the shaft and a retaining feature disposed at a second end of the shaft, wherein the shaft is disposed within the eccentric bore; and a lifting lug releasably mated to the shaft and disposed between the eccentric sleeve and the retaining feature.

2. The device of claim 1, wherein a centerline of the head is coaxial to a centerline of the shaft.

3. The device of claim 1, further including a locking arm mated proximate the second end of the shaft, wherein the eccentric sleeve and lifting lug are mated in a fixed relationship or formed as a single unit, and wherein a centerline of the head is disposed at a position proximate the first end that is translated by the offset distance with respect to a centerline of the shaft.

4. A method of attaching a rigging device to a blind flange, the method comprising:

passing a head of a pin through a bore of the flange;

translating the head of the pin an offset distance from a centerline of the bore of the flange;

placing an eccentric sleeve over a shaft mated to the head, wherein the eccentric sleeve is dimensioned to maintain the head in a non-coaxial relationship with respect to the bore of the flange; and securing a lifting lug to the shaft with a retaining feature.

5. A rigging attachment device comprising:

an eccentric sleeve having a generally cylindrical shape and an eccentric bore disposed at an offset distance from a centerline of the eccentric sleeve;

a pin having a shaft and a head disposed at a first end of the shaft and a retaining feature disposed at a second end of the shaft, wherein the shaft is disposed within the eccentric bore;

a lifting lug releasably mated to the shaft and disposed between the eccentric sleeve and the retaining feature; and a locking arm mated proximate the second end of the shaft, wherein the eccentric sleeve and lifting lug are mated in a fixed relationship or formed as a single unit, and wherein a centerline of the head is disposed at a position proximate the first end that is translated by the offset distance with respect to a centerline of the shaft.

* * * * *